US006455988B1

(12) United States Patent
Weber et al.

(10) Patent No.: US 6,455,988 B1
(45) Date of Patent: Sep. 24, 2002

(54) SPARK PLUG HAVING A PARTICULAR RESISTOR

(75) Inventors: Lothar Weber, Stuttgart; Rudolf Pollner, Bamberg; Thomas Brinz, Sindelfingen; Ulrich Eisele, Stuttgart, all of (DE)

(73) Assignee: Robert Bosch GmbH (DE)

( * ) Notice: Subject to any disclaimer, the term of this patent is extended or adjusted under 35 U.S.C. 154(b) by 0 days.

(21) Appl. No.: 09/319,564

(22) PCT Filed: Oct. 18, 1997

(86) PCT No.: PCT/DE97/02407

§ 371 (c)(1),
(2), (4) Date: Oct. 29, 1999

(87) PCT Pub. No.: WO98/26481

PCT Pub. Date: Jun. 18, 1998

(30) Foreign Application Priority Data

Dec. 11, 1996 (DE) ..... 196 51 454

(51) Int. Cl.[7] ..... H01T 13/20; H01T 13/39
(52) U.S. Cl. ..... 313/141; 313/118
(58) Field of Search ..... 313/118, 128, 313/129, 130, 134–138, 141

(56) References Cited

U.S. PATENT DOCUMENTS

| | | | | | |
|---|---|---|---|---|---|
| 4,345,179 | A | * | 8/1982 | Asai et al. | 313/136 |
| 4,393,324 | A | * | 7/1983 | Nishio et al. | 313/133 |
| 4,414,483 | A | * | 11/1983 | Nishio et al. | 313/136 |
| 4,427,915 | A | * | 1/1984 | Nishio et al. | 313/141 |
| 5,304,894 | A | * | 4/1994 | Stimson | 315/58 |
| 6,069,434 | A | * | 5/2000 | Clifford | 313/141 |

FOREIGN PATENT DOCUMENTS

| | | |
|---|---|---|
| DE | 39 05 315 | 8/1990 |
| EP | 0 171 153 | 2/1986 |

OTHER PUBLICATIONS

Patent Abstracts of Japan, vol. 015, No. 514, Dec. 27, 1991 & JP 03 225785 A (NGK Spark Plug Co. Ltd.), Oct. 4, 1991.*

* cited by examiner

*Primary Examiner*—Ashok Patel
*Assistant Examiner*—Karabi Guharay
(74) *Attorney, Agent, or Firm*—Kenyon & Kenyon

(57) ABSTRACT

A spark plug having an electrode connected via a terminal stud to an ignition lead and having a resistor arranged between the electrode and the ignition lead, the resistor having increased temperature resistance.

3 Claims, 2 Drawing Sheets

SPARK PLUG HAVING A PARTICULAR RESISTOR

FIELD OF THE INVENTION

The present invention relates to a spark plug having an electrode connected to an ignition lead via a terminal stud and having a resistor arranged between the electrode and the ignition lead.

BACKGROUND INVENTION

Spark plugs are known that use high-voltage to effect an arcing between the ground electrode and the center electrode of the spark plug in the combustion chamber of an internal combustion engine and thus ignite an air-fuel mixture that is compressed in the combustion chamber of the internal combustion engine. It is also known, in these spark plugs, to provide a resistor arranged between the ignition lead and the center electrode.

The resistor, which is arranged between the ignition lead and center electrode inside the spark plug, raises the total electrical resistance of an arrangement composed of ignition lead and spark plug. As a result of this increase in resistance, the electrical current flow within the ignition lead and the spark plug is smaller, as a result of which the level of the ignition voltage is stabilized, i.e., the voltage source producing the ignition voltage experiences smaller loads due to increased resistance in the ignition lead and spark plug, thus making it possible to maintain the ignition voltage level at a virtually constant value. The level of high voltage made available by the voltage source is of decisive importance for spark plugs, in permitting the ignition spark to form in the first place.

The level of the ignition voltage required by the spark plug in order to generate a spark between the electrodes is less than the voltage level supplied by the high voltage generator. This difference between the high-voltage supply and the actually required ignition voltage is designated as the voltage reserve. The voltage reserve is necessary to cover the increasing ignition voltage requirements due to the increasing distance between the electrodes during the course of the service life of the spark plug. Thus, if the difference between the high-voltage supply and the ignition voltage, i.e., the voltage reserve, is particularly high, then reliable ignition of the air-fuel mixture within the combustion chamber nevertheless results even if the distance between the two electrodes of the spark plug has become greater through the erosion of the electrodes, or if other parameters of the combustion process, for example, a too-thin air-fuel mixture, or deposits such as carbon black or carbonized oil, built up on the electrode from the combustion process, make necessary increased ignition voltage demand.

As a result of the decreased electrical current flow, due to increased resistance, the wear and tear on the electrodes from erosion also decreases. A smaller current flow—during the time that an electric arc burns between two electrodes—thus brings about a reduction in metal deposits on the electrodes. As a result of the smaller metal deposits, the service life of the spark plug is increased.

A further objective of the resistor between the ignition lead and the center electrode is the so-called "suppression of interference." The suppression of interference is achieved in that the resistor in the lead to a spark gap of the spark plug limits the transmission of interference pulses to the ignition leads, and thus lessens the radiated interference.

One conventional resistor used is composed of a mixture of glass, iron, carbon black, and polymer particles. Resistors of this type, however, have but slight resistance to temperature. Therefore conventionally, the resistor in the spark plug is arranged in the cooler area, thus in the area furthest from the engine.

SUMMARY

The present invention relates to a spark plug having an electrode, preferably the center electrode, that is connected to an ignition lead via a terminal stud, and having a resistor arranged between the electrode and the ignition lead, the resistor having increased resistance to temperature. This spark plug has the advantage that the resistor can be disposed in the front areas of the spark plug, thus in the vicinity of the center electrode, as a result of which, surprisingly, reduced electrode and insulation erosion takes place and, moreover, an improved "suppression of interference" is assured.

The reduced electrode and insulator erosion significantly improves the service life of the spark plug. Similarly, as a result of the reduced electrode wear, the distance between the two electrodes of the spark plug, i.e., between the center electrode and the ground electrode, is maintained virtually constant over a longer time period. If the distance between the two electrodes is approximately constant, as mentioned above, the result is that the ignition voltage demand of the spark plug remains virtually constant, the difference between the high voltage supply and the ignition voltage thus remaining at a high level, in other words, improving the voltage reserve.

In manufacturing a temperature-resistant resistor, glass or glass ceramic materials, preferably powder, are used that are preferably metalized with zero current. These materials contain neither carbon black nor temperature-unstable polymers, so that an increased resistance to temperature is assured. The structure of the resistor, in this context, is composed of a metal phase configured as a network and a glass matrix surrounding the metal phase, or a glass ceramic matrix that preferably has a layer film thickness of a few nm. In one preferred embodiment, the metal phase is manufactured using metals or metal alloys of high temperature resistance such as nickel/tungsten, platinum, or platinum/palladium. Metals or metal alloys having a high resistance value may be used so as to enable the manufacturing of resistor layers which are only a few nm, particularly 0.5–6 nm, thick.

The processes for manufacturing conventional spark plugs can very easily be transferred in an advantageous manner to the spark plug according to the present invention having a temperature-resistant resistor.

DETAILED DESCRIPTION

Figure 1:
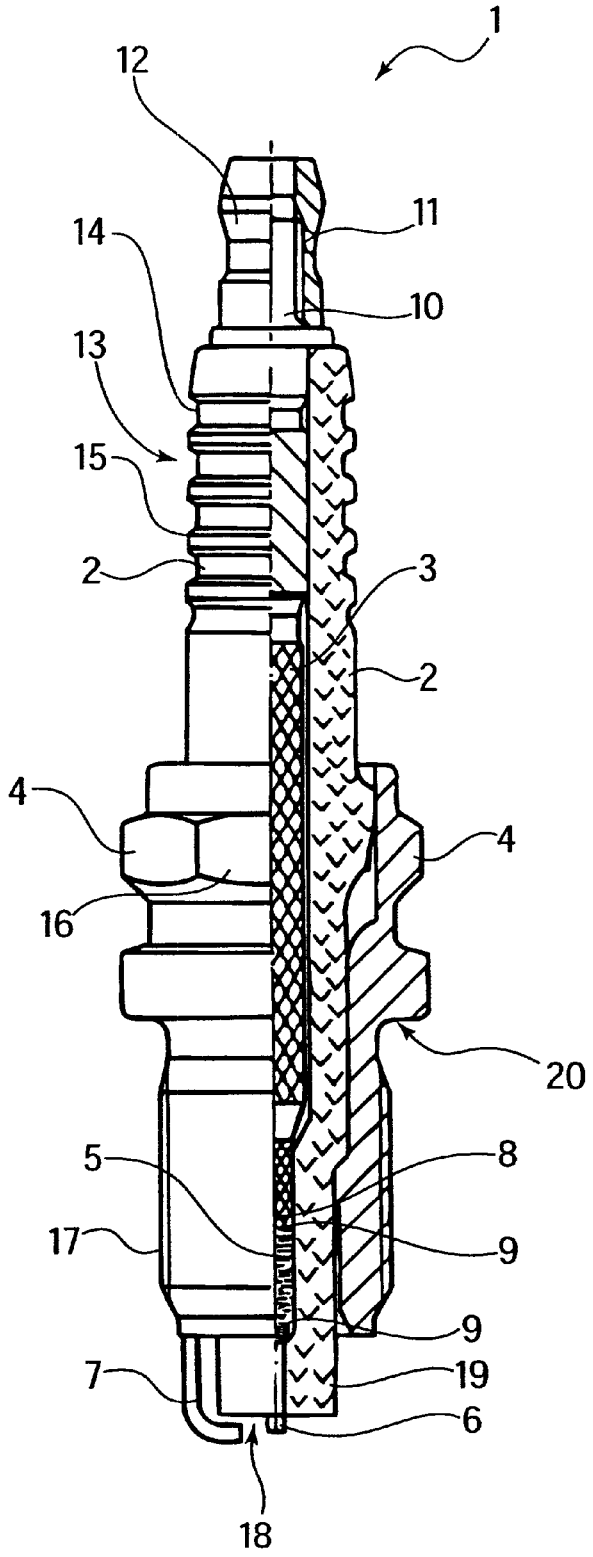
FIG. 1 depicts a side view having a partial cutaway of a spark plug according to the present invention.

FIG. 1 shows a spark plug 1, which includes an insulator 2, a terminal stud 3, a housing 4, a resistor 5, a center electrode 6, as well as a ground electrode 7. In this context, the segment of insulator 2 in housing 4 facing center electrode 6 secures and surrounds center electrode 6, resistor 5, and terminal stud 3. At both ends of resistor 5, positioned between center electrode 6 and terminal stud 3, a glass seal 9 is arranged creating a gas-tight seal. Lower end 8 of terminal stud 3 is connected to resistor 5. Upper end of 10 of terminal stud 3 extends out of insulator 2. In this context, upper end 10 is furnished with a winding 11, to which is screwed a terminal nut 12. Furthermore, insulator 2 has a so-called creeping current barrier 13. Creeping current barrier 13, in this context, has areas of insulator 2 that have smaller diameters 14 and larger diameters 15.

Housing 4 of spark plug 1 contains insulator 2, as mentioned above, in its lower area. Housing 4, in this context, includes a polygon arrangement 16 and a winding 17 as well as an angular ground electrode 7 emerging from housing 4. Ground electrode 7 is arranged in housing 4 so that it covers insulator 2 emerging below at housing 4, and it is placed at a predetermined distance 18 from center electrode 6, center electrode 6, in this context, extending from the lower area of insulator 2, here designated as insulator tip 19. The electrode arrangement depicted here is designated as a lateral electrode arrangement. The present invention can be employed in other electrode arrangements as well.

Spark plug 1 and its winding 17 are screwed into an engine housing of an internal combustion engine (not shown here) such that an end face 20 placed on housing 4 acts both as limit stop for the screw depth as well as an external sealing ring, it being also possible, in order to assure the sealing, to mount an undetachable external sealing ring (not shown here). The distance between end face 20 and the lower end of winding 17 is determined such that spark plug 1 having its electrode arrangement, which includes center electrode 6 and ground electrode 7, extends straight into a combustion chamber of the internal combustion engine (not shown here). The spark plug 1 may be screwed into the engine housing using an adjustable tool, which can be slipped onto polygon arrangement 16. If spark plug 1 is fixed in its working position in the engine housing, then an electrical connection (not shown here) is established to an electrical ignition device (not shown here) via terminal nut 12. As can be seen from FIG. 1, resistor 5 is located in a forward position in the areas closer to the engine, i.e., in the hotter areas, which is made possible by the high temperature resistance of the resistor as provided for by the present invention. Of course, it is nevertheless also provided by the present invention to mount resistor 5, employed in accordance with the present invention, in the rear areas of the spark plug facing away from the engine.

The actual functioning of the spark plug, namely to generate an arc igniting an air-fuel mixture inside a combustion chamber using an applied high voltage, is well known and is therefore not described here.

Figure 2:
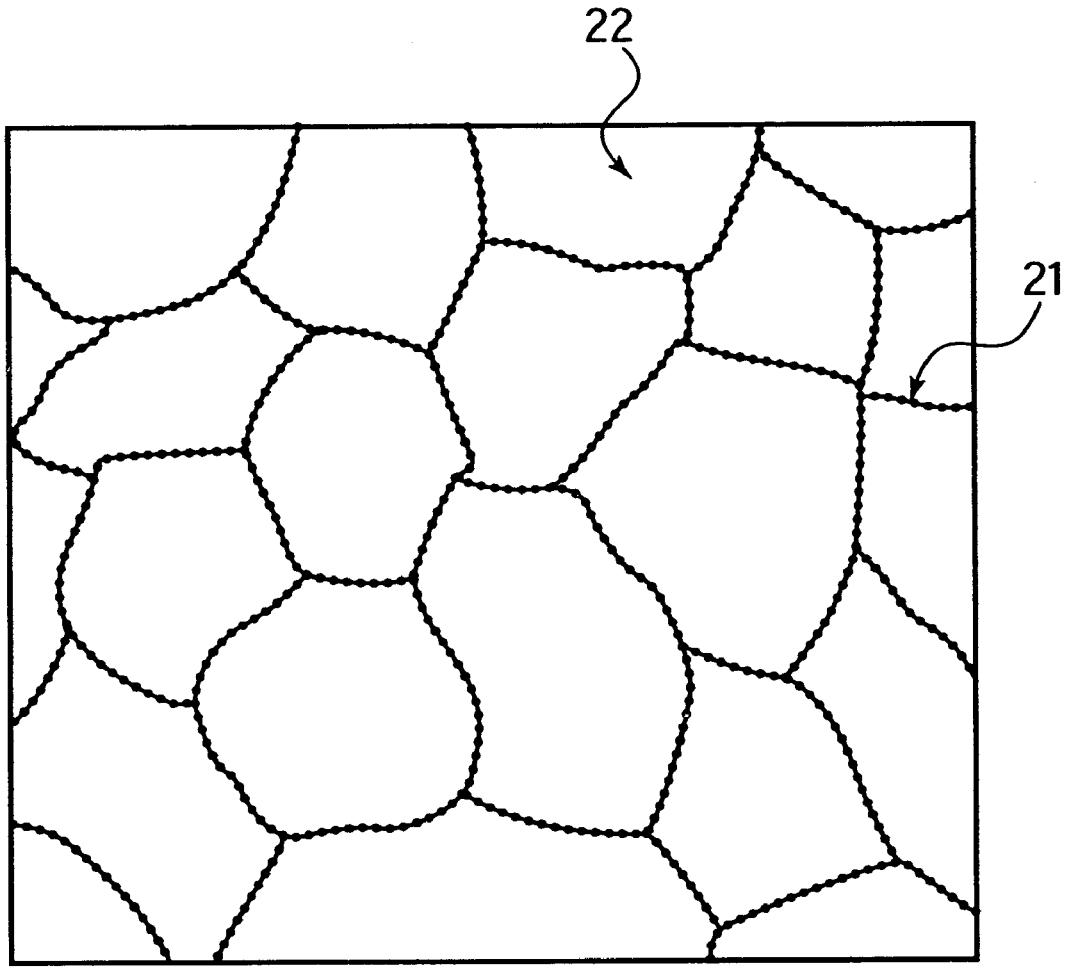
FIG. 2 depicts a view of the internal structure of the resistor of the spark plug according to the present invention.

FIG. 2 shows a structure of the resistor of the spark plug of FIG. 1. The resistor is composed of metal phase 21 configured as a network and glass matrix 22 surrounding metal phase 21. Glass matrix 22 may be a glass ceramic matrix that preferably has a layer film thickness of a few nm. In one preferred embodiment, metal phase 21 is manufactured using metals or metal alloys of high temperature resistance such as nickel/tungsten, platinum, or platinum/palladium. It may be preferred that metals or metal alloys having a high resistance value be used so as to be able to manufacture resistor layers that are preferably only a few nm, particularly 0.5–6 nm, thick.

What is claimed is:

1. A spark plug, comprising:

a terminal stud;

an ignition lead;

an electrode connected via the terminal stud to the ignition lead;

a resistor arranged between the electrode and the ignition lead, the resistor including a metal phase configured as a network and embedded in one of a glass matrix and a glass ceramic matrix, the resistor having a layer film thickness in a range of 0.5–6 nm.

2. The spark plug according to claim 1, wherein the metal phase includes one of i)nickel/tungsten, ii) platinum, and iii) platinum/palladium.

3. The spark plug according to claim 1, wherein the resistor is arranged between the electrode and the terminal stud.

* * * * *